United States Patent [19]

Montgomery, IV et al.

[11] 4,449,833

[45] May 22, 1984

[54] BREAK AWAY ALARM CLOCK

[76] Inventors: John R. Montgomery, IV, 2830 N. Burling (Unit D), Chicago, Ill. 60657; Donald R. Richardson, 15340 Larkspur, Orland Park, Ill. 60462

[21] Appl. No.: 238,927

[22] Filed: Feb. 27, 1981

[51] Int. Cl.[3] ..... G04B 13/00

[52] U.S. Cl. ..... 368/262; 368/315; 368/316; 368/317

[58] Field of Search ..... 368/72, 88, 243, 244, 368/250, 257, 262, 265, 276, 309, 315, 316, 317

[56] References Cited

U.S. PATENT DOCUMENTS 1,381,225 6/1921 Pffeifer, Jr. ..... 368/262

3,756,009 9/1973 Sapper ..... 368/315

*Primary Examiner*—B. Dobeck

*Assistant Examiner*—Terry L. Flower

*Attorney, Agent, or Firm*—Edward D. Gilhooly

[57] ABSTRACT

A clock which comprises a clock face, a casing, and a clock mechanism positioned within the casing. In accordance with this invention the casing defines separable walls, and latch means for retaining the walls in an integral, casing-defining position, with the latch means being openable to allow separation of the walls. A striker member is operatively connected through a linkage to the latch means whereby striking of the striker member can open the latch means to permit the walls to move from their integral, casing-defining position to their separated positions.

11 Claims, 11 Drawing Figures

FIG. 1
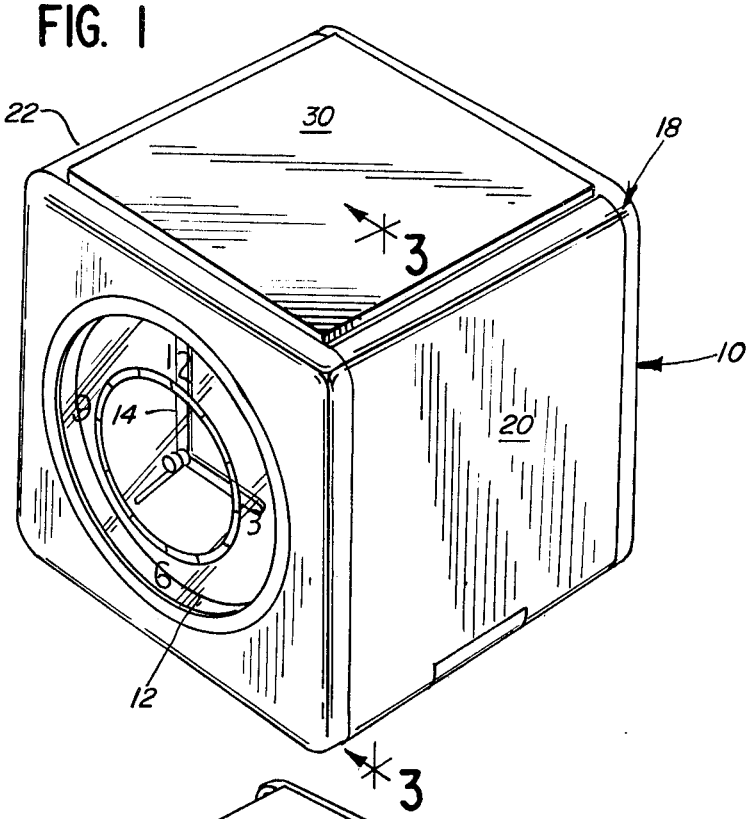
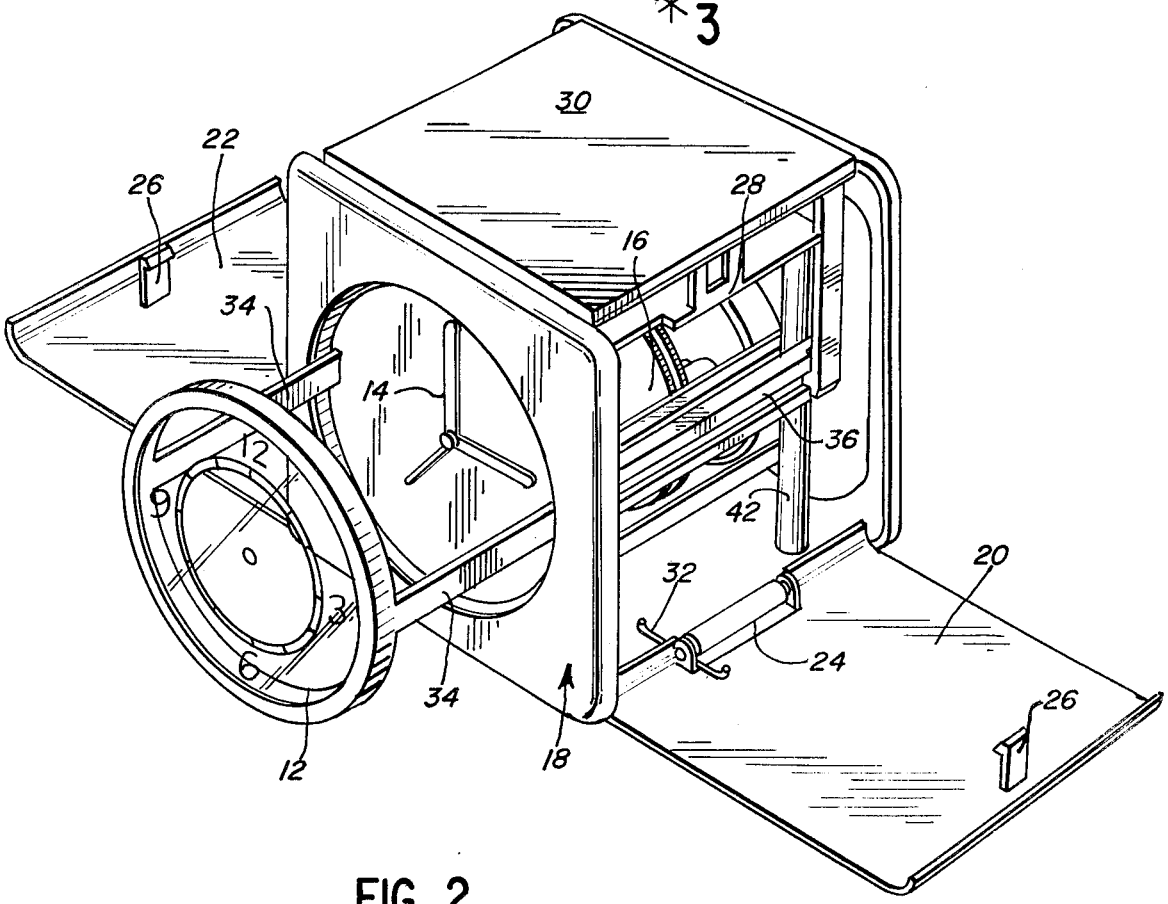
FIG. 2

FIG. 3
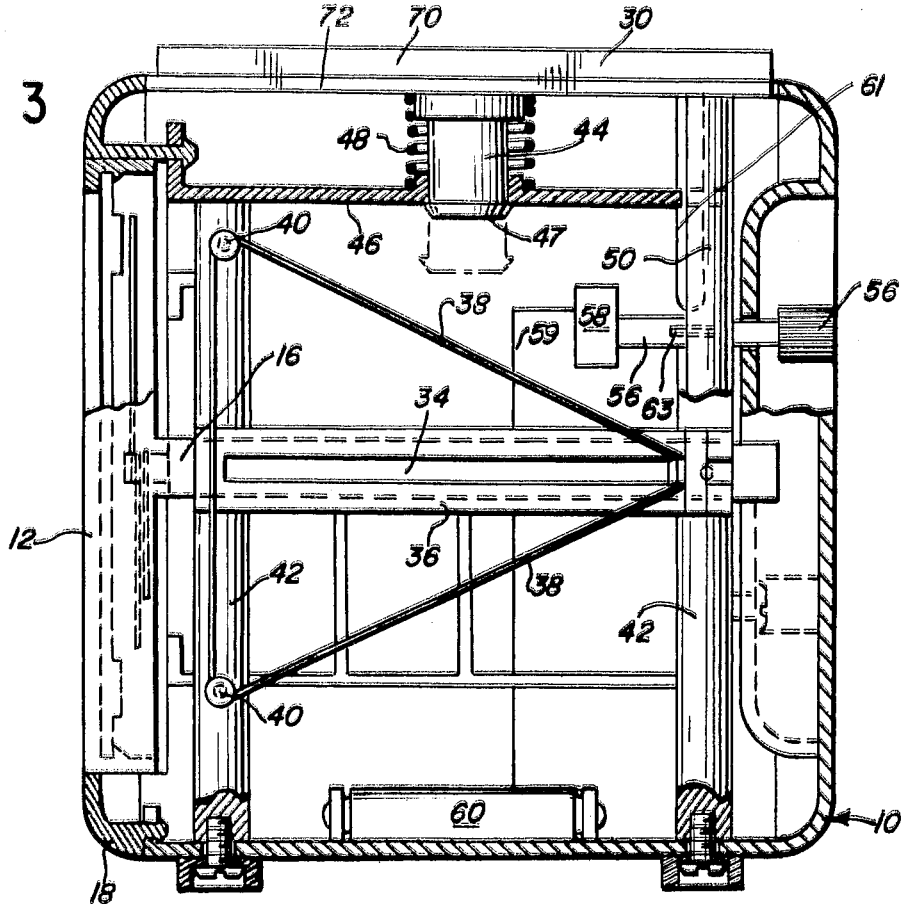
FIG. 4
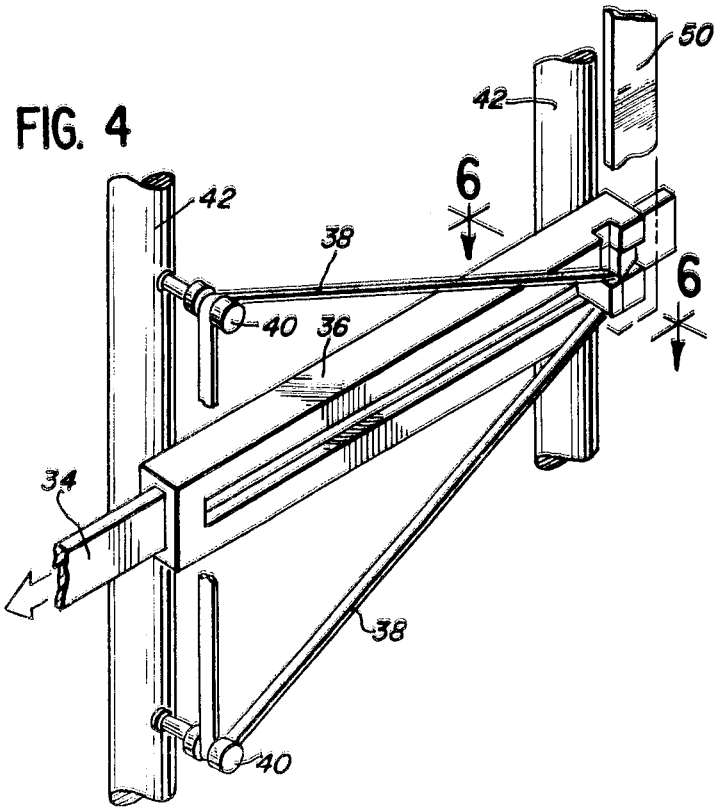
FIG. 5
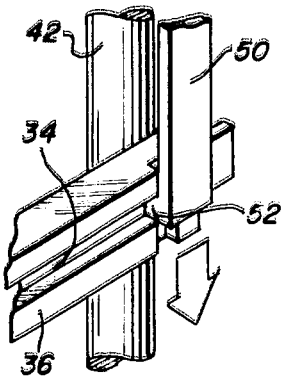
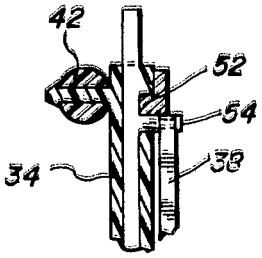
FIG. 6

BREAK AWAY ALARM CLOCK

BACKGROUND OF THE INVENTION

This application relates to an improvement in clocks, particularly alarm clocks and the like.

For many it is a painful experience to be wakened by an alarm clock in the morning. Some are forced to suppress the urge to hurl the offending alarm clock across the room. By this invention, the newly-wakened victim of the alarm clock is provided with an opportunity to strike back at his tormentor. The clock of this invention is equipped with a striking pad which may be hit with the fist, with the result that the alarm clock disassembles, but in a manner which permits the easy reassembly of the device later on. Thus, the awakened sleeper can start off the day with a therapeutic moment of self-expression, for an improvement of his mood and sense of well being.

DESCRIPTION OF THE INVENTION

In accordance with this invention a clock is provided which comprises a clock face, a casing, and a clock mechanism positioned in the casing. The casing defines separable walls, and latch means for retaining the walls in integral, casing-defining position, with the latch means being openable to allow separation of the walls. A striker member is operatively connected to the latch means. As the result of this, striking of the striker member by the newly-awakened sleeper can open the latch means to permit the walls to move from their integral, casing-defining position to their separated position.

Specifically, at least some of the separable walls of the casing may be attached in hinged relation to the remainder of the casing either through a mechanical hinge, or by the use of a polyethylene or other plastic "living" hinge in which one edge, particularly the bottom, of each of the hinged separable walls is integrally attached to the remainder of the casing as a single, molded piece of plastic.

The separable walls may be spring-biased toward their separated position, so they spring outwardly into the separated position when the latch means is struck.

It may also be desirable for at least one of the separable walls to be carried by slide rod means extending into the casing. The latch means in this circumstance may retain the slide rod means in an inward position to retain the walls in the integral, casing-defining position. Spring means may be used to urge the slide rod means toward an outward position, with the result that the wall carried thereby is moved into its separated position by striking of the striker member.

Specifically, the clock face and clock mechanism may be carried by the one separable wall which is carried by the slide rod means. In this circumstance, the clock controls which may be positioned on the wall opposite the one separable wall may communicate by connection rods extending between the clock mechanism and the clock controls, in which the connection rods are transversely split at an intermediate point along its length to define a pair of facing, intermediate ends at the intermediate point. Thus, as the spring means urges these slide rod means toward their outward position, the connection rod or rods separate at their intermediate points to permit the clock face and clock mechanism to be projected outwardly.

The intermediate ends of the connection rods may define mating, interlocking surfaces which may be longitudinally moved as described above to separate and rejoin as part of the rod means are longitudinally moved. However, the mating, interlocking surfaces permit each rod means to be rotated as a single unit when the intermediate ends are in rejoined relation, so that the clock controls may be operative in conventional manner. Typical clock controls which will be used are the clock hand setting controls, and also an alarm setting control which may, if desired, also be a rotating rod, to switch an alarm unit into an "on" position, with the striker member being adapted to shut the alarm unit off.

One intermediate end of each rod means may define tongue means and the other intermediate end may define groove means to receive the tongue means. Specifically, both intermediate ends may define tongue and groove means for a mating pattern which permits rotation of the rod means as a unit, while permitting it to separate at the intermediate point along its length.

DESCRIPTION OF THE DRAWINGS

FIG. 1 is a perspective view of one embodiment of the clock of this invention, shown with the casing walls in their casing-defining positions.

FIG. 2 is a perspective view of the clock of FIG. 1 with the casing walls shown in their separated positions.

FIG. 3 is a sectional view taken along line 3—3 of FIG. 1.

FIG. 4 is a fragmentary, perspective view of an interior portion of part of the interior of the casing of the clock of FIGS. 1 through 3.

FIG. 5 is a further detailed perspective view of an interior portion of the casing as further shown in FIG. 4.

FIG. 6 is a sectional view taken along line 6—6 of FIG. 4.

DESCRIPTION OF SPECIFIC EMBODIMENT

Figure 7:
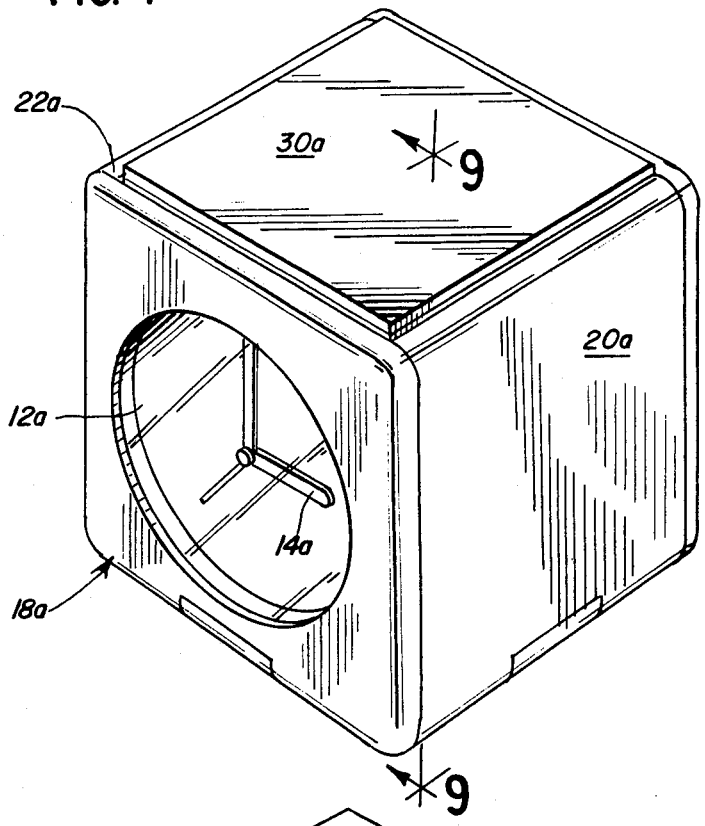
FIG. 7 is a perspective view of another embodiment of the clock of this invention, shown with the walls of the casing in their integral, casing-defining position.

Referring to FIGS. 1 through 6, an alarm clock 10 is shown which defines a clock face 12 and hands 14 in the conventional manner of an alarm clock, and a clock mechanism 16 positioned within a casing 18. Clock 10 may be electric, or battery operated, or of the spring-wound type.

As described above, casing 18 may define separable walls 20, 22, with clock face 12 also defining a separable wall as specifically shown in FIG. 2.

Separable walls 20, 22 are attached in hinged relation to the remainder of casing 28 by means of hinges 24 if desired, or, alternatively, an integral plastic "living" hinge may be utilized with walls 20, 22 being an integrally molded part of casing 18. Walls 20, 22 are attached at their lower edges so that they can fall outwardly as shown in FIG. 2. Alternatively, walls 20, 22 may be held at their lower edges by separable detents, for complete separability of the walls.

A latch means is provided, comprising in the instance of FIG. 2 a hook member 26 on each of walls 20, 22 and a latch piece 28 positioned on each side of a vertically movable striker plate 30, positioned at the top of clock 10. A spring 32 urges each wall 20, 22 into its outward position of FIG. 2. Accordingly, when the clock is in the position of FIG. 1, and one strikes the striker plate 30, it is moved downwardly, causing latch pieces 28 to disengage with hook members 26, with the result that walls 20, 22 fall outwardly, biased by springs 32 into their outer positions. Thereafter, they may be reconnected with the latch pieces 28 so that the clock may be reassembled into its FIG. 1 configuration.

Clock face 12, which may carry the numerals of the clock, may be carried by a pair of slide rods 34 which extend into casing 18 in slide members 36. An elastic band 38 is positioned on pins 40, which may be carried by posts 42 as part of casing 18, to urge slide rods 34 to drive clock face 12 into its outward position as shown in FIG. 2.

Striker plate 30 can be seen in FIG. 3 to be carried on a central pin 44 which projects through an aperture in an upper interior wall 47 of casing 18, and is biased by spring 48 into an outward position. Flange 47 may be provided to prevent pin 44 from disengaging with wall 46.

Accordingly, when striker plate 30 is struck, it is depressed, along with latch members 28 as described previously, and depending rods 50 as shown particularly in FIGS. 4 through 6. Depending rods 50 can release the slide rods 34 to cause the structure to move from the configuration of FIGS. 1 and 3 to that of FIG. 2. Specifically, depending rod 50 may carry a hook member 52 which disengages from a corresponding slot in slide rod 34 when it moves downwardly, so that elastic band 38, carried on slide rod 34 about pin 54, is free to move its slide rod forward as previously described.

The apparatus of this invention can operate with a single mechanism of the type shown in FIG. 4, but it is generally preferred for both slide rods 34 to be equipped with an elastic band 38 and related parts.

Various clock controls such as control 56 may be provided in the back of clock 10 in conventional manner. The interior workings of the clock mechanism itself are not shown in FIG. 3 for purposes of clear disclosure, but may be of conventional design.

Also, striker plate 30 may be linked to an otherwise conventional alarm system in clock 10 so that the depression of striker plate 30 can activate switch 58, which may be connected to alarm 60 so that closing of the switch causes alarm 60 to shut off. Alarm control 56 can be rotated to actuate switch 58 to the "on" position. When striker plate 30 is depressed, plunger 61 is also depressed to strike fin 63 on the side of alarm control 56, causing it to rotate to turn switch 58 back to the "off" position, thus shutting off the alarm.

Figure 8:
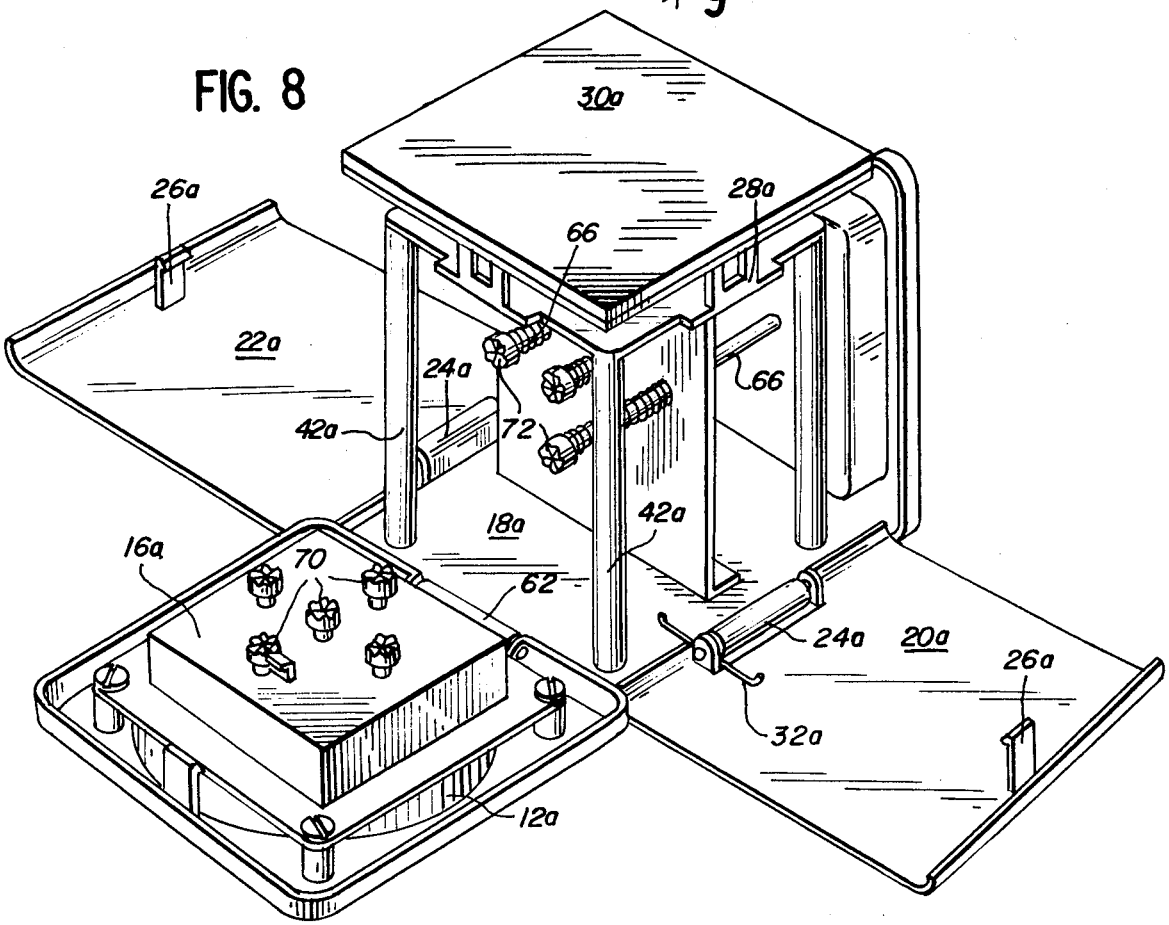
FIG. 8 is a perspective view of the clock of FIG. 7, shown after striking of the latch means to cause the walls to fall into their separated positions.
Figure 9:
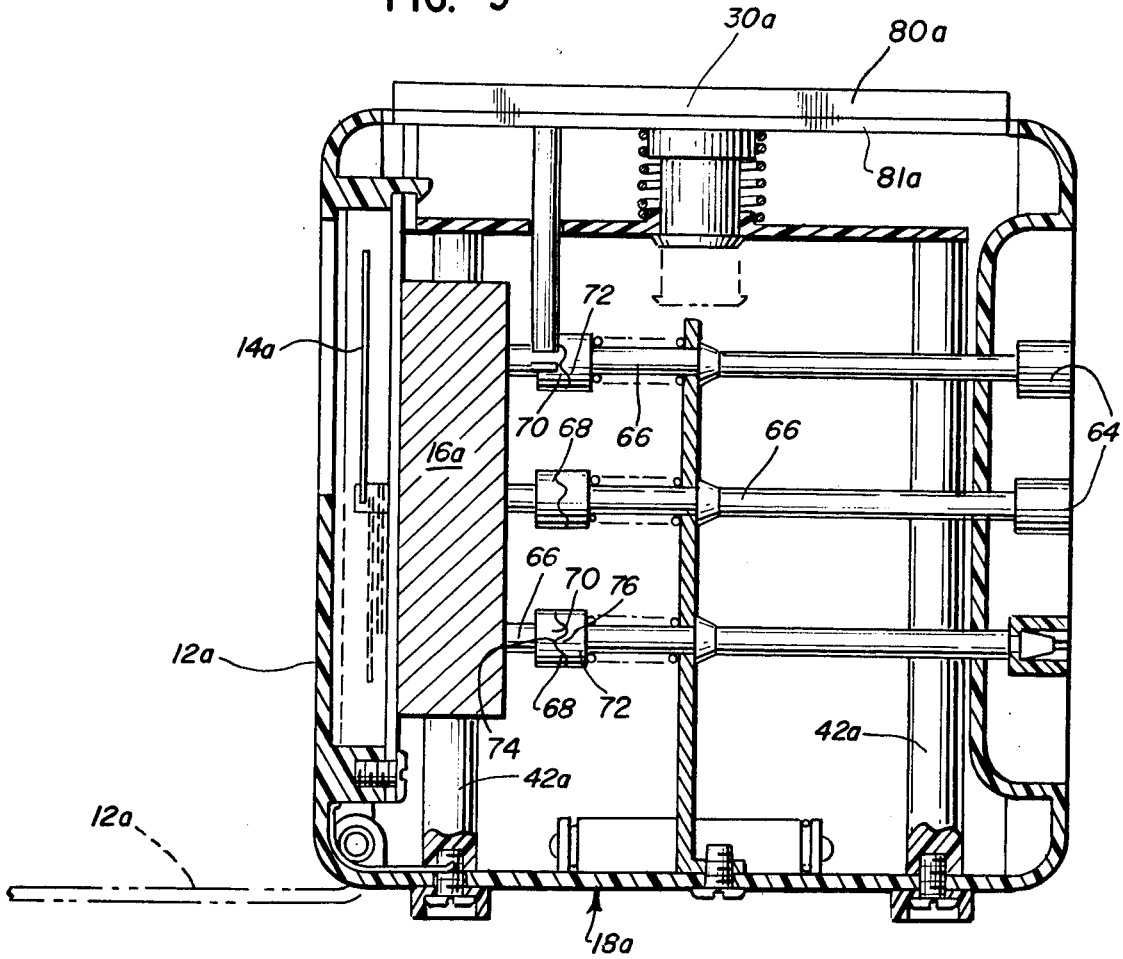
FIG. 9 is a sectional view taken along line 9—9 of FIG. 7.

Referring to FIGS. 7 through 9, a clock of similar design is disclosed having certain added modifications in accordance with this invention.

In a manner similar to that previously disclosed, a casing 18*a* comprises a clock face 12*a* and a clock mechanism 16*a* positioned within the casing. The casing defines similar separable walls 20*a* and 22*a*, and latch means 26*a*, 28*a* of similar design to the previously described latch means. Striker member 30*a* is also provided, being of similar design to the previous embodiment, so that latch means 26*a*, 28*a* may be opened to rotate about hinge 24*a*, impelled by springs 32*a* in a manner as previously described. In this embodiment, clock face 12*a* includes the entire front wall of the casing, being attached to casing 18*a* with another hinge 62 which may be of a mechanical design or may also constitute an integral "living" hinge of plastic as previously described.

In this present embodiment the clock mechanism 16*a* is carried by the clock face wall 12*a*, so that it pivots with the clock face.

As shown, the controls 64 are provided for setting the clock, operating the alarm and the like, which controls may be of generally conventional design. As part of the controls, connection rods 66 are provided, extending between clock mechanism 16*a* and the outer controls 64, which are manually accessible at the back of casing 18*a*. Connection rods 66 are transversely split at intermediate points 68 along their lengths to define a pair of facing, intermediate ends 70, 72 (FIG. 8). The intermediate ends, in turn, define mating, interlocking surfaces as shown which thus may be longitudinally moved into separate relationship as may be seen in FIG. 8, and which may then be longitudinally moved to rejoin as shown in FIG. 9 as at least a portion of the rod means 66 is longitudinally moved. This permits each rod means to be rotated as a single unit when the intermediate ends 70, 72 are in rejoined relation. Thus clock controls 64 may be used to control the positions of hands 14*a* of the clock when in the closed position of FIG. 9. Nevertheless, the clock is capable of collapsing outwardly as shown in FIG. 8.

In this particular embodiment the alarm control may desirably be also controlled by a rotating shaft between on and off positions, or one of the controls 64 may be utilized to press the alarm control inwardly to activate it, with depression of striker plate 30*a* being adapted to push the alarm control outwardly once again by a conventional mechanism means.

Particularly, each of the intermediate ends may define tongue means 74 which fit into groove means 76 of the other intermediate ends, as a specific type of profiled surface which permits longitudinal separation coupled with the ability to interlock and rotate when not in separated relation.

It can be seen that striker members 30, 30*a* for each of the foregoing embodiments preferably overlie substantially the entire upper surface of the casing. They may be made of a resilient material 80, 80*a* such as vinyl plastic, or the like, backed on a stiff plate 81, 81*a*.

By way of alternative, clock mechanism 16*a* may be permanently attached to upstanding rods 42*a* of casing 18*a*. Accordingly, only clock face 12*a* falls forward in this circumstance in a manner described above, upon actuation by striker plate 30*a*, with the clock mechanism 16*a* and the hands 14*a* remaining stationary. This can avoid shock to the clock mechanism, and eliminate the need for the separable connection in the connection rods 66.

Figure 10:
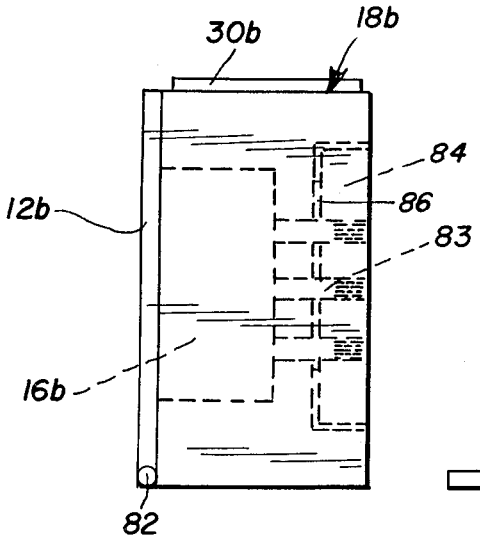
FIG. 10 is a schematic side elevational view of another embodiment of the clock in accordance with this invention, shown with its walls in the integral, casing-defining position.
Figure 11:
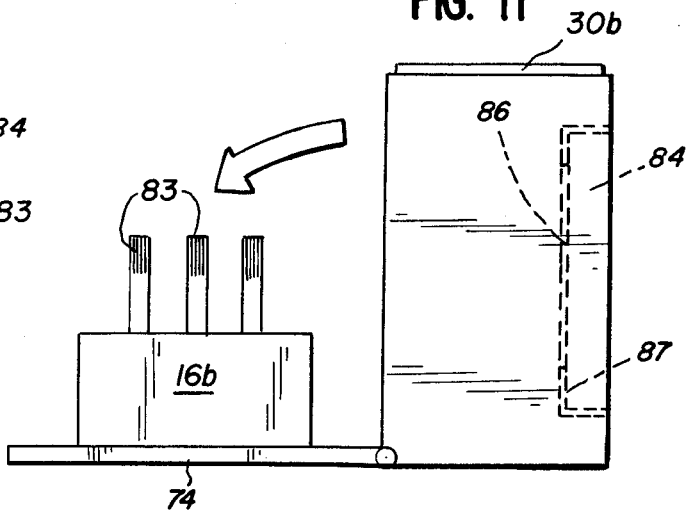
FIG. 11 is a schematic side elevational view of the clock of FIG. 10 with a casing wall in a separated position.

Referring to FIGS. 10 and 11, a schematic view of another embodiment of the clock of this invention is disclosed. Casing 18*b* includes the clock face 12*b* and clock mechanism 76 as in the previous embodiments. If desired, side walls analogous to walls 20 and 22 may be provided. Striker plate 30*b*, of similar function to the previous embodiments, is also disclosed. In this embodiment, upon the striking of plate 30*b*, clock face 12*b* is released to rotate about hinge 82 to fall forwardly as shown in FIG. 11, bringing clock mechanism 16*b* with it.

In this embodiment, clock control shafts 83 are provided as single units, projecting into open recess 84 at the back of the clock when in the closed position of FIG. 10. Upon opening, as clock face 16*b* falls forwardly, clock control shafts come with it, rotating through aperture 86 in the inner wall 87 of recess 84, which apertures may be one or more vertical slots, so that the controls 82 can fall free of their engagement with inner wall 87 to assume the configuration of FIG. 11.

The alarm controls and their link up to striker pads 30*b* may be similar to the design as described in the embodiment of FIGS. 1 through 6.

The resulting clock thus has the capability of being struck to cause its walls to disengage from the remainder of its casing, to fly outwardly in a manner simulating destruction. Simultaneously, the alarm may be shut off by the pressing of the striker plate.

The above has been offered for illustrative purposes only, and is not intended to limit the invention of this application, which is as defined in the claims below.

That which is claimed is:

1. A clock comprising a clock face, a casing, and a clock mechanism positioned within said casing, said casing including a plurality of separable walls, said separable walls being mounted for outward movement from a closed, casing-defining configuration to an open configuration separated from said casing and exposing at least a portion of the interior of the casing, latch means operatively coupled to said plurality of walls and having an engaged position for normally retaining said walls in said closed, casing-defining position and a released position permitting said outward movement from said closed configuration to said open configuration, force applying means coupled to said said separable walls for causing said outward movement, striker means mounted on said casing and being operatively connected to said latch means, said striker means being responsive to a manual force to cause said latch means to change from said engaged position to said released position, said force applying means automatically moving said plurality of separable walls outward to said open configuration upon said latch means changing to said released position.

2. The clock of claim 1 in which said plurality of separable walls are attached in hinged relation to the remainder of said casing.

3. The clock of claim 1 in which said plurality of separable walls are spring-biased toward their separated position.

4. A clock comprising a clock face, a casing, and a clock mechanism positioned within said casing, said casing including at least one separable wall, said at least one separable wall being mounted for outward movement from a closed, casing-defining configuration to an open configuration separated from said casing, latch means operatively coupled to said at least one wall and having an engaged position for normally retaining said at least one wall in said closed, casing-defining position and a released position permitting said outward movement from said closed configuration to said open configuration, means coupled to said at least one separable wall for causing said outward movement, striker means mounted on said casing and being operatively connected to said latch means, said striker means being responsive to a manual force to cause said latch means to change from said engaged position to said disengaged position and effect said outward movement of said at least one separable wall, said at least one separable wall includes a plurality of separable walls, each of said walls being moveable to said open position in response to said manual impact force on said striker means, and at least one of said plurality of separable walls is carried by slide rod means extending into said casing, said latch means retaining the slide rod means in an inward position to retain said walls in the integral, casing-defining position, and spring means urging said slide rod means toward an outward position and the wall carried thereby into its separated position.

5. The clock of claim 4 in which said clock face and clock mechanism are carried by said one separable wall, clock controls positioned on the wall opposite said one separable wall, and connection rod means extending between said clock mechanism and clock controls, said connection rod means being transversely split at an intermediate point along its length to define a pair of facing, intermediate ends, said intermediate ends defining mating, interlocking surfaces which may be longitudinally moved to separate and rejoin as at least a portion of the rod means is longitudinally moved, and which permit each rod means to be rotated as a single unit when the intermediate ends are in rejoined relation.

6. The clock of claim 5 in which one intermediate end defines tongue means and the other intermediate end defines groove means to receive said tongue means.

7. A clock comprising a clock face, a casing, and a clock mechanism positioned within said casing, said casing including at least one separable wall, said at least one separable wall being mounted for outward movement from a closed, casing-defining configuration to an open configuration separated from said casing, latch means operatively coupled to said at least one wall and having an engaged position for normally retaining said at least one wall in said closed, casing-defining position and a released position permitting said outward movement from said closed configuration to said open configuration, means coupled to said at least one separable wall for causing said outward movement, striker means mounted on said casing and being operatively connected to said latch means, said striker means being responsive to a manual force to cause said latch means to change from said engaged position to said disengaged position and effect said outward movement of said at least one separable wall, and said striker member is positioned at the top of said casing and overlies substantially the entire upper surface of said casing.

8. A clock comprising a clock face, a casing, and a clock mechanism positioned within said casing, said casing including a plurality of separable walls, said plurality of separable walls being mounted for outward movement from a closed casing-defining configuration separated from said casing, latch means operatively coupled to each of said plurality of walls and having an engaged position for normally retaining said plurality of separable walls in said closed, casing-defining position and a released position permitting said outward movement from said closed configuration to said open configuration, means coupled to said plurality of separable walls causing said outward movement, control means being operatively connected to said latch means, said control means being responsive to a manual force for causing said latch means to change from said engaged position to said disengaged position and effecting said outward movement of said plurality of separable walls, and at least one of said separable walls is carried by slide rod means extending into said casing, said latch means retaining the slide rod means in an inward position to retain said walls in the integral, casing-defining position, and spring means urging said slide rod means toward an outward position and the wall carried thereby into its separated position.

9. A clock comprising a clock face, a casing, and a clock mechanism positioned within said casing, said casing including a plurality of separable walls, said plurality of separable walls being mounted for outward movement from a closed casing-defining configuration separated from said casing, latch means operatively coupled to each of said plurality of walls and having an engaged position for normally retaining said plurality of separable walls in said closed, casing-defining position and a released position permitting said outward movement from said closed configuration to said open configuration, means coupled to said plurality of separable walls, causing said outward movement, control means being operatively connected to said latch means, said control means being responsive to a manual force for causing said latch means to change from said engaged position to said disengaged position and effecting said outward movement of said plurality of separable walls, and said clock face and clock mechanism are carried by said one separable wall, clock controls positioned on the wall opposite said one separable wall, and connection rod means extending between said clock mechanism and clock controls, said connection rod means being transversely split at an intermediate point along its length to define a pair of facing, intermediate ends, said intermediate ends defining mating, interlocking surfaces which may be longitudinally moved to separate and rejoin as at least a position of the rod means is longitudinally moved, and which permit each rod means to be rotated as a single unit when the intermediate ends are in rejoined relation.

10. The clock of claim 9 in which said clock face and clock mechanism are carried by said one separable wall, clock controls positioned on the wall opposite said one separable wall, and connection rod means extending between said clock mechanism and clock controls, said connection rod means being transversely split at an intermediate point along its length to define a pair of facing, intermediate ends, said intermediate ends defining mating, interlocking surfaces which may be longitudinally moved to separate and rejoin as at least a portion of the rod means is longitudinally moved, and which permit each rod means to be rotated as a single unit when the intermediate ends are in rejoined relation.

11. The clock of claim 10 in which one intermediate end defines tongue means and the other intermediate end defines groove means to receive said tongue means.

* * * * *